US008904570B2

(12) United States Patent
Brooks

(10) Patent No.: US 8,904,570 B2
(45) Date of Patent: Dec. 9, 2014

(54) CONCEALED WATERLESS URINAL

(75) Inventor: Norman W. Brooks, London (CA)

(73) Assignee: Resno Corporation Ltd., London, Ontario (CA)

( * ) Notice: Subject to any disclaimer, the term of this patent is extended or adjusted under 35 U.S.C. 154(b) by 600 days.

(21) Appl. No.: 13/291,181

(22) Filed: Nov. 8, 2011

(65) Prior Publication Data

US 2012/0117719 A1 May 17, 2012

(51) Int. Cl.
*A47K 11/00* (2006.01)

(52) U.S. Cl.
USPC ..... 4/144.1

(58) Field of Classification Search
CPC ..... A61G 9/006; A47K 11/12
USPC ..... 4/144.1, 301, 307
See application file for complete search history.

(56) References Cited

U.S. PATENT DOCUMENTS

| | | | | |
|---|---|---|---|---|
| 202,193 | A * | 4/1878 | Reid | 4/307 |
| 4,488,321 | A * | 12/1984 | Brunton | 4/301 |
| 7,636,957 | B2 * | 12/2009 | Funari | 4/301 |

* cited by examiner

*Primary Examiner* — Huyen Le

(57) ABSTRACT

A waterless urinal for easy installation in bathroom and non bathroom areas of a residence. The waterless urinal includes a urinal housing with an integral drain assembly and removable door. The waterless urinal enables the discharge of urine without the need for flushing with water. A protective layer of specialized liquid is used to mask the urine in the urinal and prevent odors.

11 Claims, 7 Drawing Sheets

CONCEALED WATERLESS URINAL

BACKGROUND OF THE INVENTION

The present invention relates to a waterless urinal for use in a residential bathroom or non bathroom area.

OBJECTS AND ADVANTAGES

The object and advantage of the invention is to provide a waterless urinal in a residential non bathroom area which eliminates the need for flushing with water, which is easy to manufacture, and which is easy to install or retrofit in any room of a dwelling.

Other objects are to provide a urinal that blends with the wall and is odorless.

Further objects and advantages will become apparent from a study of the following description and accompanying drawings.

SUMMARY OF THE INVENTION

In accordance with one embodiment of the present invention, a urinal housing is provided for installation in a residence as described. The housing is accessed by a door, which is adapted to open and close against the frame to permit urine transfer into the housing as required. A U-shaped trough is provided on the interior of the door for channelling urine into the housing. An integral drain assembly is provided underneath the housing which fluidly communicates with the housing by means of a drain opening in the housing. The drain assembly comprises a urine trap reservoir and a removable urine trap insert. The urine trap reservoir is a container having a bottom, an inlet opening at the top fluidly communicating directly with the drain opening, and an elevated outlet opening within the container above the bottom thereof. The urine trap insert is a vertically elongated closure with a cover. The urine trap insert circumscribes the elevated outlet in the urine trap reservoir and is aligned within the drain. The urine trap insert is retained in place above the bottom of the reservoir container by means of engagement of the cover with the floor of the housing.

In accordance with another embodiment of the invention, the framed opening has a bottom ledge which cooperates with the underside of the door trough to enable the door to pivot outwardly from a closed position against the frame to an open position.

In accordance with yet another embodiment of the invention, a protective layer of liquid is provided inside the drain assembly as described. The liquid has a density lower than that of urine and functions to form an overlying seal on the urine in the reservoir.

DESCRIPTION OF THE DRAWINGS

In order that the invention may be more clearly understood, a preferred embodiment thereof will now be described in detail by way of example, with reference to the accompanying drawings, in which.

DESCRIPTION OF THE PREFERRED EMBODIMENT

Figure 1:
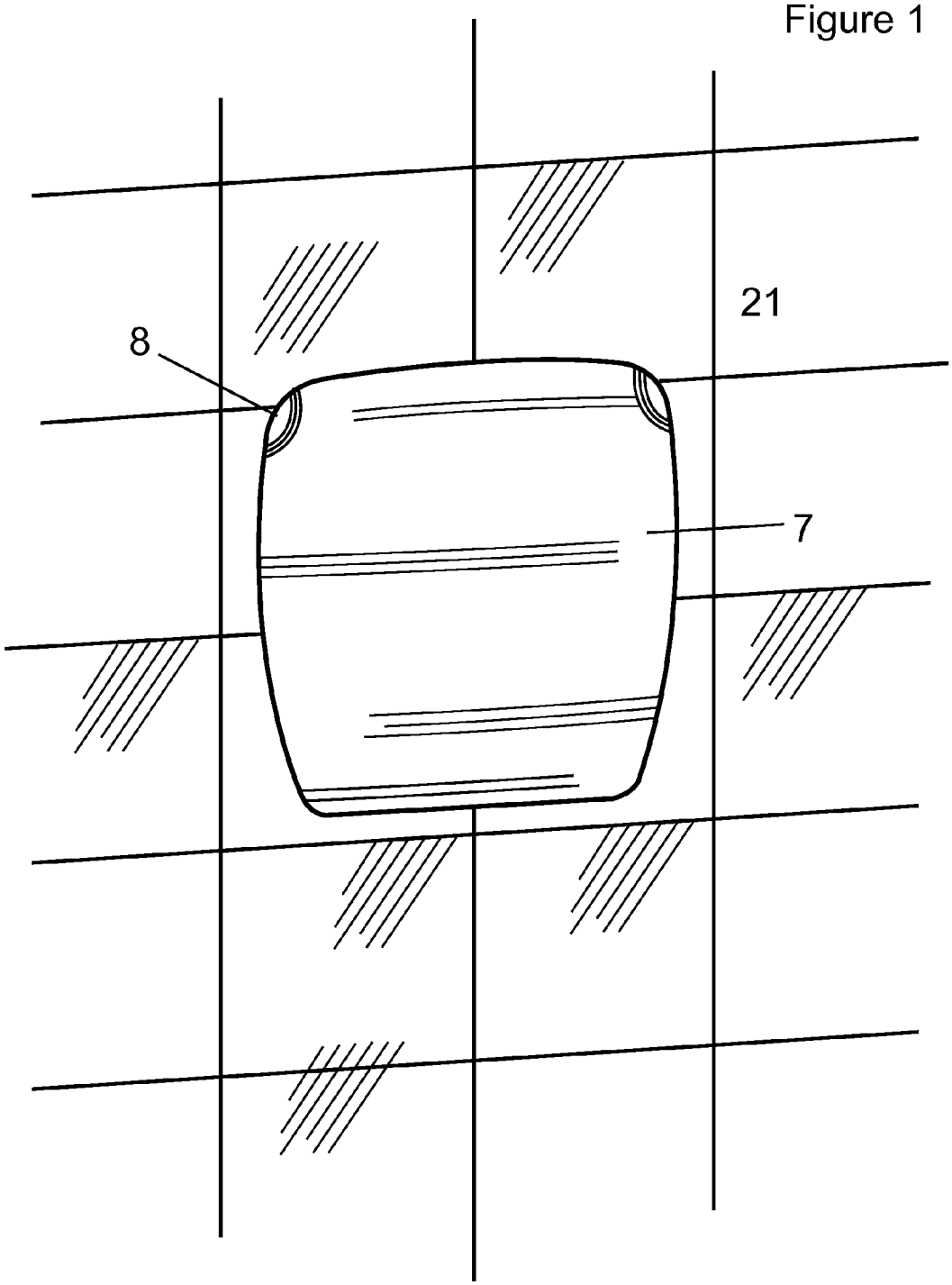
FIG. 1 is a plan view of an installed urinal assembly showing the door in the closed position against a vertical wall.
Figure 2:
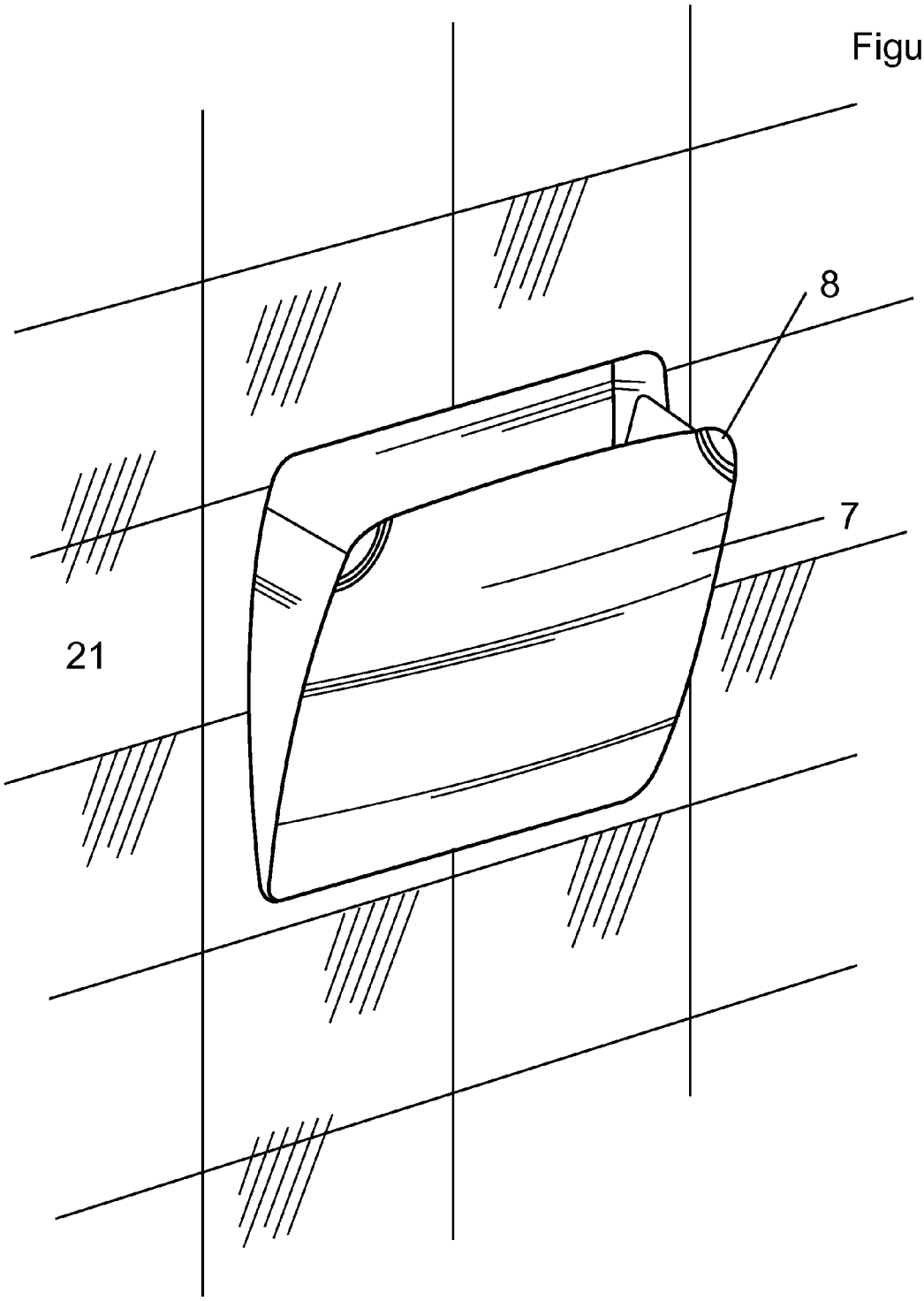
FIG. 2 is a perspective view of the installed waterless urinal illustrating the opening of the door.

The waterless urinal according to this invention is intended for easy installation and use in a bathroom or non bathroom area of the home such as, for example, the bedroom. As shown in FIGS. 1 and 2, the urinal is installed flush against the wall 21 and is accessed by means of a door 7 which pivots outwardly for use and otherwise functions to close the urinal as will hereinafter be described. The door 7 has grips 8 on the top corners of the door for the user to grasp to operate the door 7. The door of the urinal is the only visible part of the urinal in the room.

Figure 3:
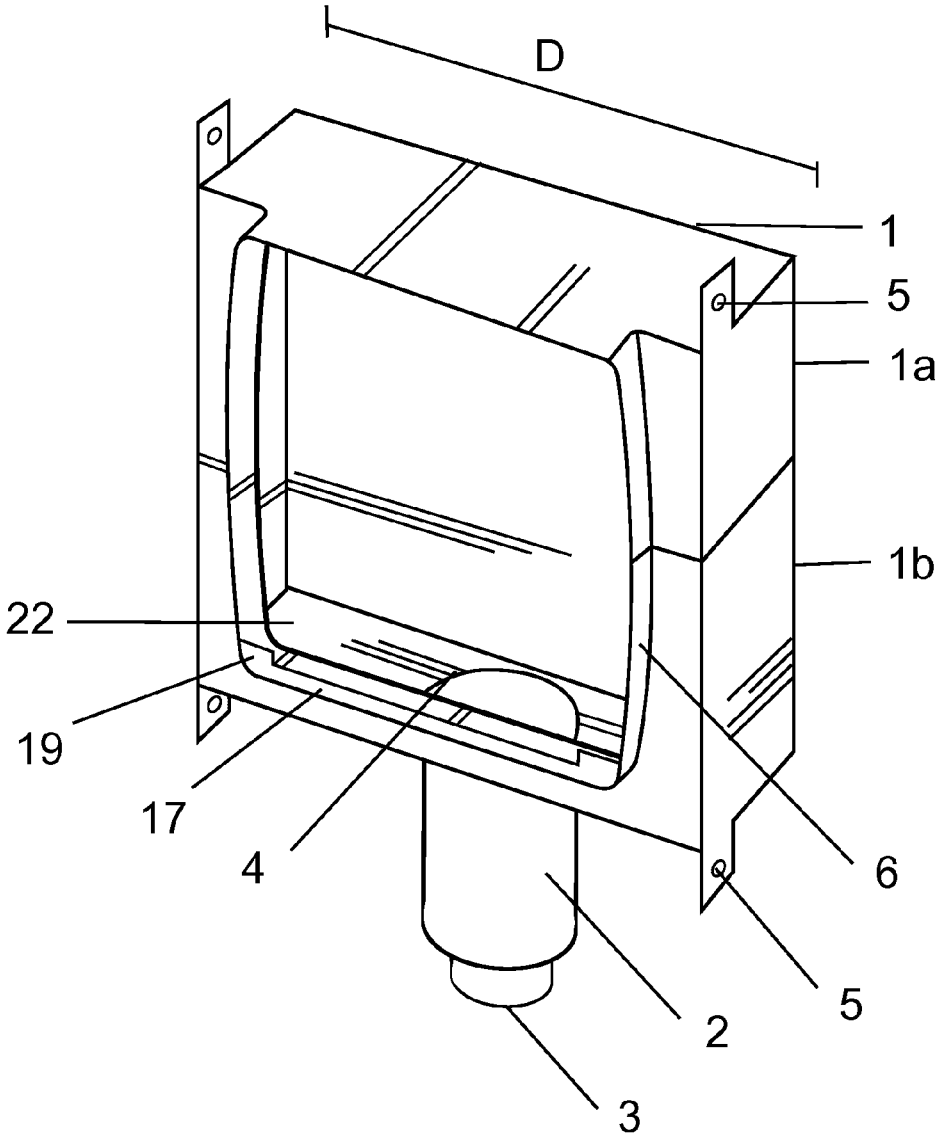
FIG. 3 is a perspective view of the waterless urinal housing.

Referring to FIG. 3, the urinal further comprises a urinal housing 1 and a specialized waterless drain assembly 2 underneath the housing below the drain opening. A circular drain opening 4 communicates with the drain assembly wherein the urine is conveyed therethrough to the house drain pipe (not shown). The urinal installation may be OEM or a retrofit requiring only a connection to a conventional drain pipe. A drain pipe fitting 3 at the bottom of the drain assembly is provided for attachment to the drain pipe.

The urinal housing is prefabricated and its width D is sized to be installed between the 2×4 wall studs by means of integral attachment tabs 5 which are adapted to receive a fastener therethrough. The housing portions can be fabricated by means of, for example, injection molding using a suitable plastic material such as ABS. In one embodiment the housing is manufactured in two pairs 1*a* and 1*b* and joined together by conventional means. The door accessed opening to the housing is provided with an outwardly extending flange like border 6 to allow for the flush installation of wall board around the opening.

Referring to FIGS. 2 and 3, the housing is provided with a front door accessed opening having an upright ledge 17 along the bottom on which the door 7 is seated and on which the door pivots between the open and closed positions.

Figure 4:
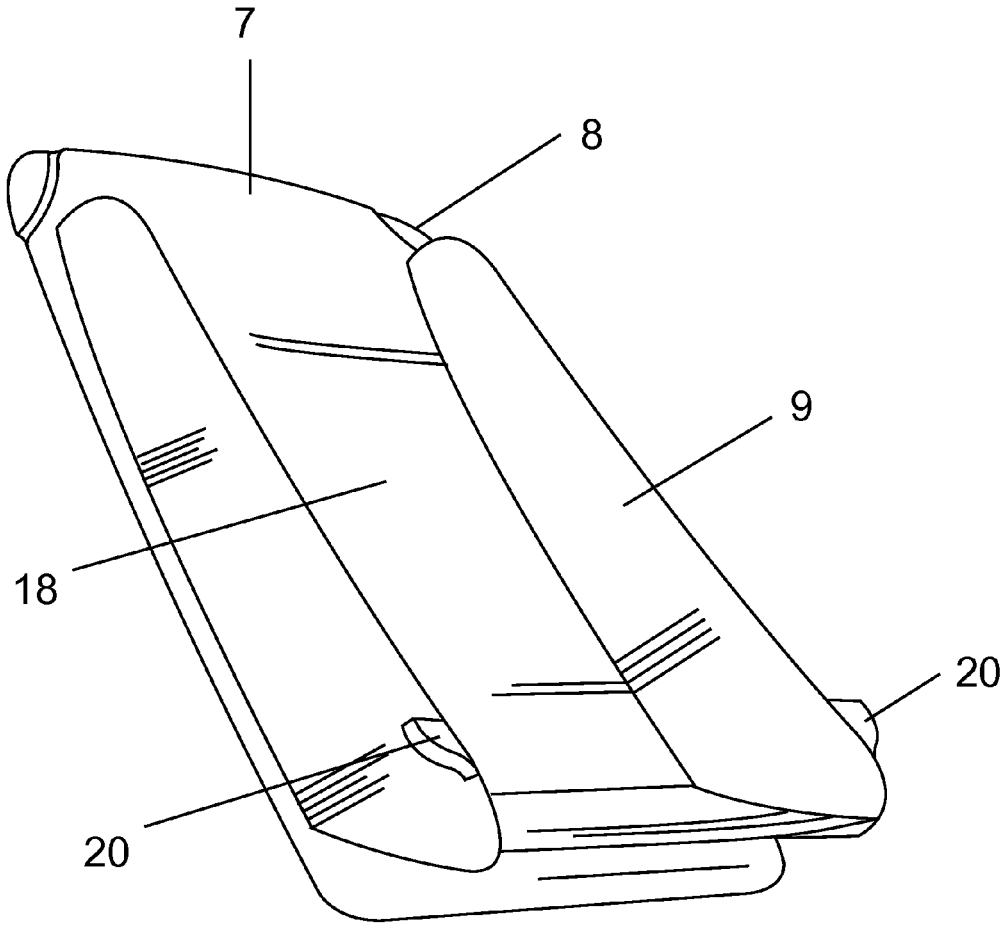
FIG. 4 is a perspective view of the door of the waterless urinal.

Referring to FIG. 4, the interior of the door is configured with a U-shaped trough having sides 9 with lower edges and bottom for channeling the urine into the housing. Referring to FIG. 3, the lower edges of the door engage the ledge between the alignment guides 19 which center the door on the housing. Referring to FIGS. 2, 3 and 4, the door 7 pivots outwardly on the ledge 17 which motion is limited by the lugs 20 provided on each side. The lugs 20 engage the inside of the housing opening at the point of maximum door opening. In the open position, the interior door surface and sides 9 function as a trough to channel the urine into the housing for discharge into the housing and drain opening 4. The drain assembly 2 is installed directly underneath the drain opening 4 of the housing as shown in FIG. 3.

Referring to FIGS. 2, 3 and 4, the vertical sides 9 of the door opening are tapered upwardly and inwardly from the centre point 18 so as to present a greater width at the centre line than the operative width of the door 7. This allows for the easy insertion of the removable door 7 through the greater center width whereupon the door may be lowered into position. The retaining lugs 20 at the sides are dimensioned to fit through the centre of the opening to be thereby secured behind the door opening edge when the door 7 is lowered into its pivoting position. The door 7 accordingly easily lifts out for periodic cleaning and sanitizing.

Figure 5:
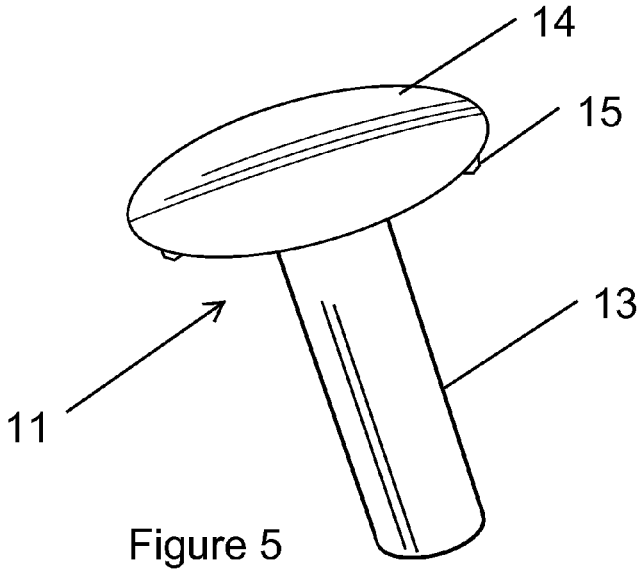
FIG. 5 is a perspective view of the urine trap insert.
Figure 7:
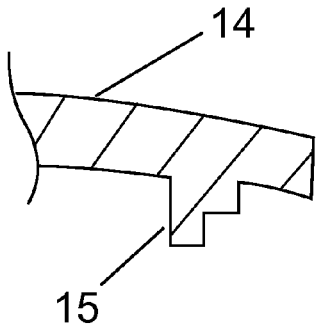
FIG. 7 is a partially sectional view of the cover of the urine trap insert illustrated the spacer means.
Figure 6:
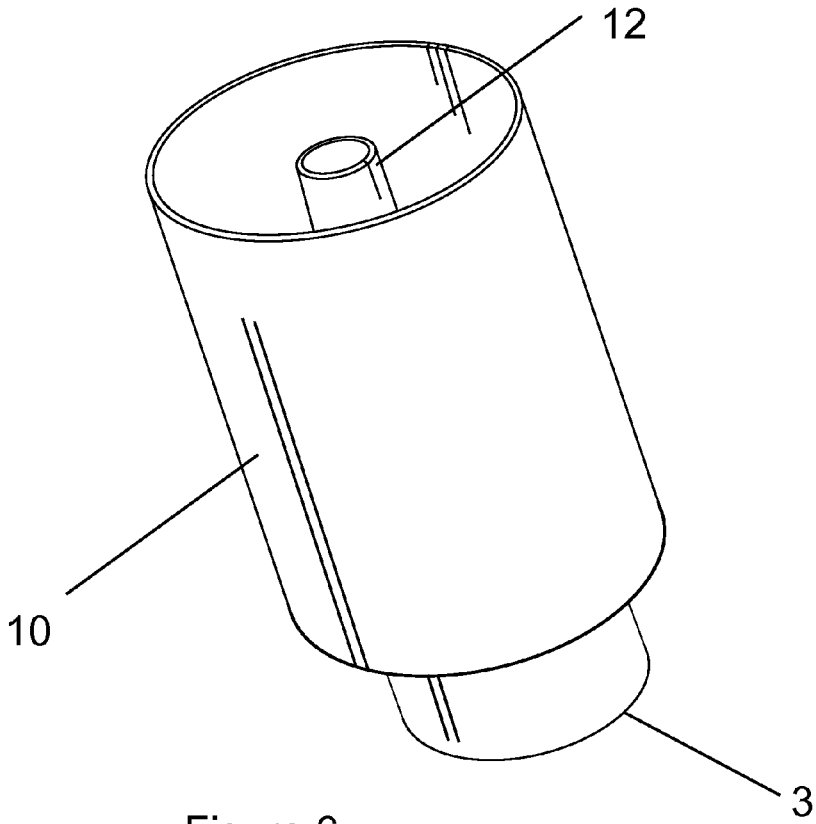
FIG. 6 is a perspective view of the urine trap reservoir.

Referring to FIGS. 5, 6 and 7, the drain assembly 2 consists of a urine trap reservoir 10 to collect the urine and a urine trap insert 11 which functionally co-operates with the urine trap reservoir 10 to discharge an added volume of urine into the drain opening 4 as will be hereinafter described.

Figure 8:
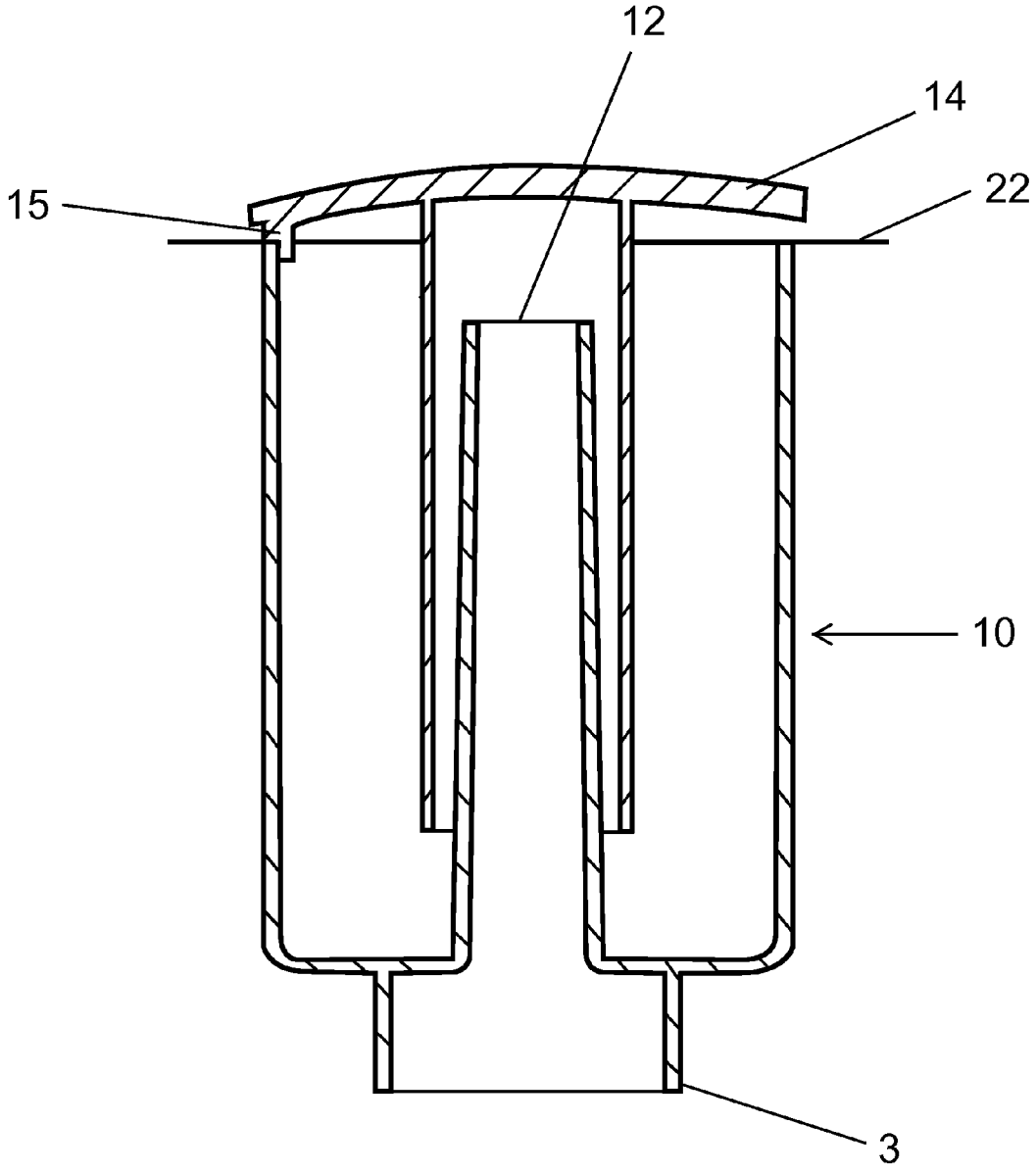
FIG. 8 is a cross sectional view of the drain assembly.
Figure 9:
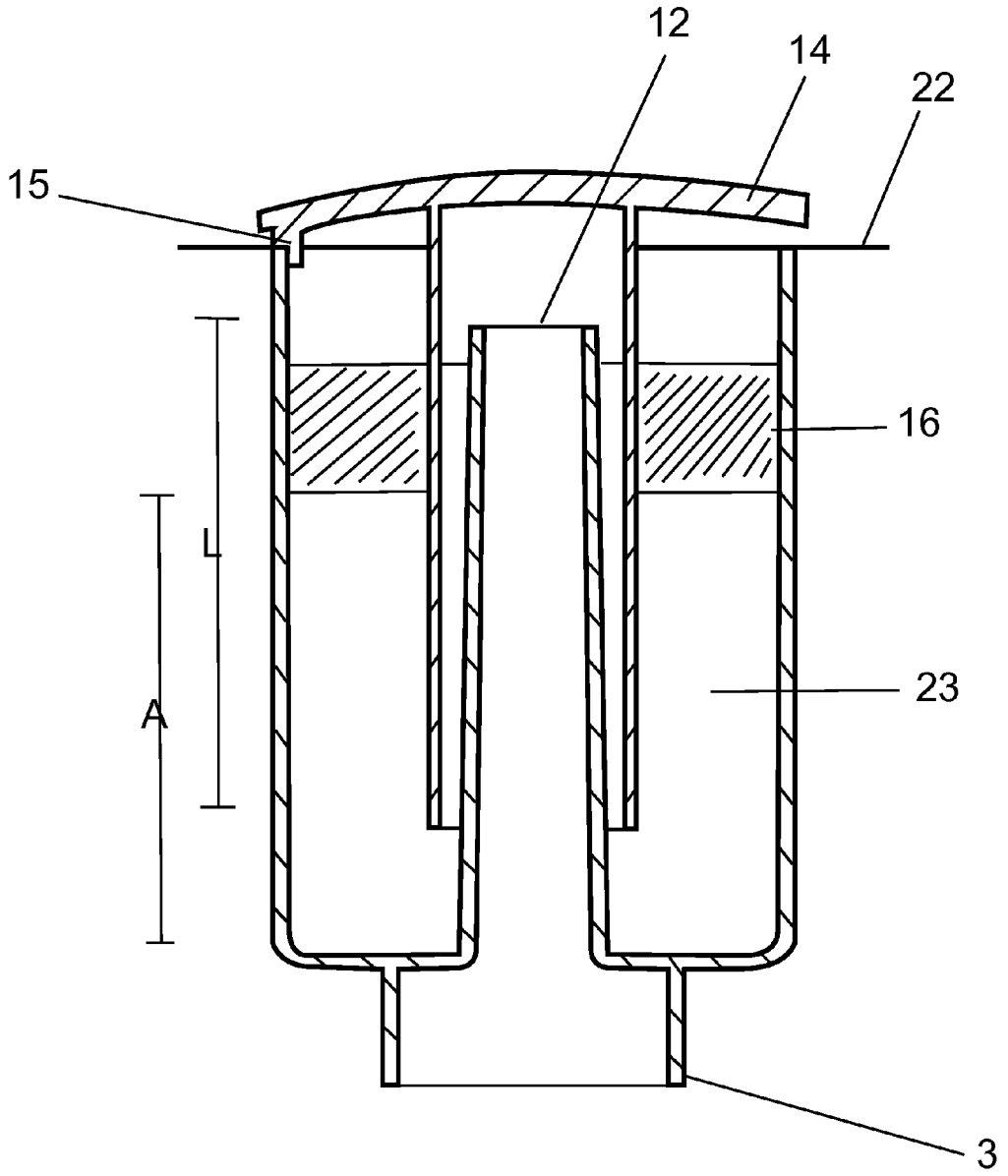
FIG. 9 is a cross sectional view of the drain assembly illustrating the fluid level.

The urine trap reservoir 10 is concentrically shaped and has an elevated drain outlet port 12. The removable urine trap insert 11 has an inverted pipe 13 having a closure 14 at the top end thereof. The diameter of the urine trap insert pipe 13 is greater than the diameter of the drain outlet port 12 and circumscribes the elevated drain outlet port 12 of the urine trap reservoir 10 and is retained in place by resting over the drain opening 4. Referring to FIGS. 8 and 9, the operative length L of the trap insert pipe 13 is selected to ensure that it remains above the floor of the reservoir in order to provide passage for the urine 23 thereunder. The urine trap insert 11 is seated and retained in position above the drain by suitable spacer means 15 provided on the underside periphery of the closure 14 maintaining said cover in spaced apart relationship to the floor 22. The closure 14 resting on the spacer means 15 is thus above the floor 22 of the housing to permit the flow of urine 23 from the housing into the trap reservoir 10. The urine trap insert 11 is removable to permit cleaning of the urine trap reservoir 10.

The drain assembly 2 may be initially primed using water as the urine liquid whose density is functionally equivalent to urine. As such a volume of water is poured into the reservoir to a first height A which is below the elevated drain. Next, the trap insert is installed. Following, the Blue Seal® liquid is added in overlying sealing relationship to the water or urine shown as the "dark layer 16 in FIG. 9. The density of the Blue Seal® liquid is less than water or urine enabling it to float on the urine. Once the volume of urine in the container rises above the height of the elevated drain outlet, it naturally overflows under the action of gravity into the drain outlet and is thereby discharged. In this way, the urine in the container will automatically drain into the elevated outlet. The Blue Seal® liquid readily available on the open market is a mixture of aliphatic alcohol and surfactants. A material data safety sheet is attached as FIG. 8 by way of example of a suitable liquid.

In operation, a volume of urine 23 is added to the urinal and flows through the drain opening 4 into the trap reservoir 10. Since the urine is denser than the Blue Seal® liquid, the urine flows through the Blue Seal® layer to comingle with the urine in the urine trap reservoir. The added volume of the urine in the reservoir creates a dynamic head above the elevated drain outlet 12 which operates to discharge the added volume of urine into the elevated drain outlet for discharge into the house sewer. It is expected that approximately 3 ounces of blue seal will last for a minimum of 1500 uses.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed:

1. A urinal housing having a door accessed framed opening and a drain opening; a door in said framed opening adapted to open and close against the frame to permit urine transfer to said housing as required;

an integral drain assembly beneath the housing comprising a urine trap reservoir and a removable urine trap insert;

said urine trap reservoir comprising a container having a bottom, an inlet opening at the top fluidly communicating directly with the drain opening, and an elevated outlet opening inside the container above the bottom thereof;

said urine trap insert comprising a vertically elongated closure comprising a cover said closure circumscribing said elevated outlet, said closure aligned within the drain and retained in place above the bottom of the reservoir container by means of engagement of said cover with said floor of the housing.

2. The invention as claimed in claim 1, wherein said door comprises a U-shaped trough on the interior thereof for channeling urine into the housing.

3. The invention as claimed in claim 2, wherein said framed opening has a bottom ledge and wherein the underside of said trough rests on said bottom ledge of the opening and wherein the door is thereby enabled to pivot on said ledge outwardly from a closed position against the frame to an open position.

4. The invention as claimed in claim 3, wherein the door has retaining means to limit the maximum opening of the door.

5. The invention as claimed in claim 4, wherein said retaining means for the door consists of at least one outwardly aligned lug attached to the side of the trough for engaging against the inside of the frame to thereby limit further outward movement.

6. The invention as claimed in claim 5, wherein said housing has a standardized width dimension.

7. The integral drain assembly of claim 6, wherein said urine trap insert cover is retained in place in a spaced apart relationship above the floor of the housing by spacer means located on the underside of said cover.

8. The invention as claimed in claim 6, wherein said urine trap insert cover is perforated to permit the passage of urine therethrough into the drain.

9. The invention as claimed in claim 7 or 8, wherein a protective layer of liquid having a lower density than that of urine is used in the reservoir to form an overlying sealing relationship to the underlying urine.

10. The invention as claimed in claim 9, wherein the protective layer of specialized liquid is Blue Seal®.

11. The invention as claimed in claim 8, wherein when a volume of urine is added to the reservoir, the urine flows through the drain opening into the reservoir, through the protective layer of specialized liquid to raise the total liquid level above the said elevated outlet and wherein an equal volume of urine is thereby discharged into the outlet under the action of gravity.

* * * * *